United States Patent [19]

Baechler et al.

[11] Patent Number: 4,643,071

[45] Date of Patent: Feb. 17, 1987

[54] RECOILLESS LAUNCHING DEVICE

[75] Inventors: Theodor Baechler, Marklkofen-Warth; Josef Amann, Schrobenhausen, both of Fed. Rep. of Germany

[73] Assignee: Messerschmitt-Bolkow-Blohm GmbH, Fed. Rep. of Germany

[21] Appl. No.: 749,002

[22] Filed: Jun. 26, 1985

[30] Foreign Application Priority Data

Jul. 4, 1984 [DE] Fed. Rep. of Germany ..... 3424598

[51] Int. Cl.[4] ..... F41F 3/02; F41F 15/00

[52] U.S. Cl. ..... 89/1.701; 89/1.705

[58] Field of Search ..... 89/1.701, 1.705, 1.706, 89/1.704, 1.7

[56] References Cited

U.S. PATENT DOCUMENTS

| | | | |
|---|---|---|---|
| 2,156,605 | 5/1939 | Prettyman | 89/1.701 |
| 3,771,417 | 11/1973 | Schnabele et al. | 89/1.701 |
| 3,796,128 | 3/1974 | Zeyher | 89/1.701 |
| 4,050,351 | 9/1977 | Stauff | 89/1.701 |
| 4,073,213 | 2/1978 | Stauff | 89/1.701 |
| 4,132,148 | 1/1979 | Meistring et al. | 89/1.701 |

*Primary Examiner*—David H. Brown

*Attorney, Agent, or Firm*—McGlew and Tuttle

[57] ABSTRACT

The countermass of a recoilless launching device is composed of a combustible material and has a firing connection with the working space in which the propellant charge burns up.

14 Claims, 6 Drawing Figures

RECOILLESS LAUNCHING DEVICE

FIELD AND BACKGROUND OF THE INVENTION

The present invention relates in general to recoilless weapons and in particular to a new and useful recoilless launching device for launching a projectile which includes a countermass made of combustible material.

Launching device having countermasses are known. The countermass may be constituted by an easily disintegrable material such as a stack of thin leaflets (see U.S. Pat. No. 3,796,128), with the stack dispersing after being ejected, so that the leaflets, due to the high air resistance, are quickly braked and thus keep the area behind the launcher safe.

With a launching from an aircraft, however, such a countermass does not offer a satisfactory safety since the leaflets impinge on the following aircrafts and may, for example, penetrate into air intakes of the aircraft and destroy compressors in the aircraft engines.

A countermass suitable for aircrafts is known from U.S. Pat. No. 4,050,351. It is integrated in a rocket booster. upon expelling the countermass, the rocket booster is ignited, so that the countermass is impulsed oppositely to the direction of expulsion. Because of the rocket booster, this prior art countermass is relatively expensive. Primarily, however, it requires an exact proportioning between the speed of expulsion of the countermass, and the impetus of the booster, since with an insufficient impetus, no safety is obtained at the rear of the launcher, and with an excessive impetus, the aircraft may be endangered.

SUMMARY OF THE INVENTION

The present invention is directed to a launching device of the above mentioned kind comprising a countermass which cannot become dangerous, neither to the area behind, nor to the aircraft.

Accordingly an object of the present invention is to provide a recoilless launching device comprising a launching tube having a bore with opposite open ends, a pair of spaced apart sabots in said tube bore defining a working space therebetween which can be pressurized with propellant charge vapors for expelling a projectile that is moved by one of the sabots, a countermass in the bore associated with the other sabot and on a side of the other sabot opposite from the working space and set off connection means connecting the countermass with the working space for igniting the countermass, the countermass being made of combustible material.

A further object of the invention is to provide a launching device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

Embodiments of the invention are described in more detail in the following, with reference to the drawings in which.

DESCRIPTION OF THE PREFERRED EMBODIMENTS

Figure 1:
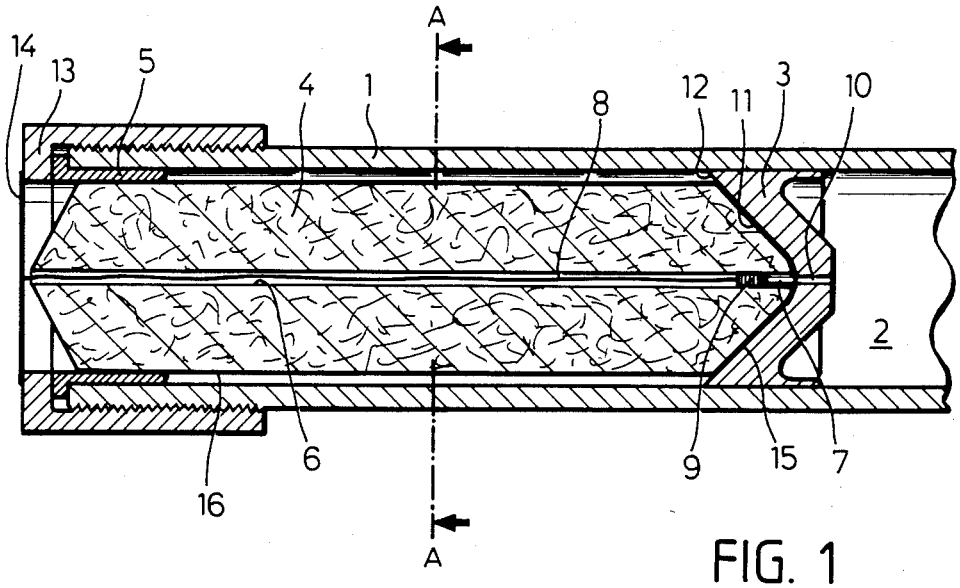
FIG. 1 is a partial longitudinal sectional view of a launcher tube.
Figure 1A:
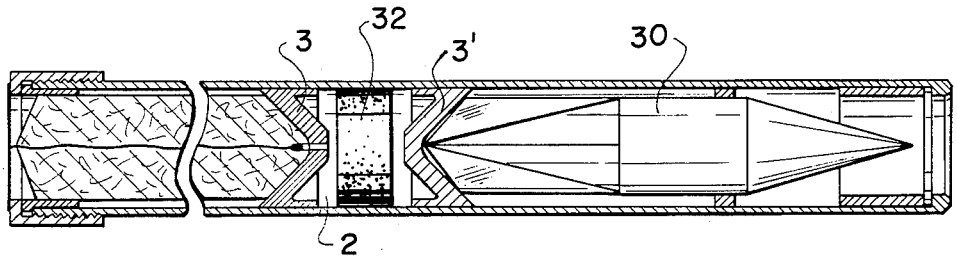
FIG. 1A is a view similar to FIG. 1, but also showing the second sabot and missile.

As shown in FIGS. 1 and 1A a launcher tube 1 comprises a working space 2, a sabot 3, a countermass 4, and a braking sleeve 5.

Working space 2 is bounded by sabot 3 and another sabot 3' by which the projectile 30 is ejected. Working space 2 becomes pressurized with the gases and smoke of a propellant charge 32.

Figure 2:
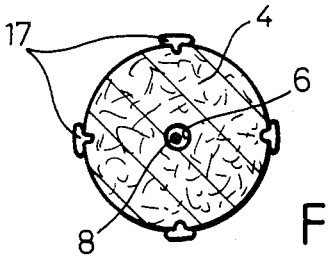
FIG. 2 is a cross sectional view taken along the line A—A of FIG. 1.

Countermass 4 comprises a combustible material, for example an extruded or cast propellant or explosive, such as nitrocellulose, a secondary explosive, etc., or even combinations thereof. Further, as shown in FIGS. 1 and 2, countermass 4 is providd with an inner passage 6 in the form of a central bore extending axially through the entire countermass 4. A retardation charge 7 is inserted in the end portion close to sabot 3 of inner passage 6, and a hivelite cord or a primercord 8 to be initiated by a detonator 9 extends through the remaining part of passage 6.

To establish a firing connection, sabot 3 is provided with a central bore 10 through which retardation charge 7 communicates with working space 2. In a manner known per se, sabot 3 has a concave surface 11 which applies against the countermass and terminates circumferentially in a rim having an acute front edge 12.

Braking sleeve 5 is secured by a screwed ring 13 against being driven out.

The rear end of the tube is covered by a sealing foil 14. Except for the area of the firing bore 10, a refractory, thermally insulating damming layer 15 is provided between sabot 3 and countermass 4, to make sure that the countermass 4 will be set off exclusively through retardation charge 7. A slide layer 16, for example, of an aluminum foil, is provided around the countermass to prevent an ignition by friction at braking sleeve 5, particularly if a composite propellant comprising ammonium perchlorate or potassium perchlorate is employed. Uniformly spaced-apart spacers, for example, styropore strips 17, are provided on the outer circumference of countermass 4 to ensure a centered position thereof in tube 1.

The inventive device operates as follows:

Upon igniting the propellant charge, hot powder vapors pass through bore 10 in sabot 3 and ignite retardation charge 7. Simultaneously, the pressure built up in the working space 2 expels countermass 4 by means of sabot 3 out of tube 1.

Sabot 3 penetrates by its acute front edge 12 between braking sleeve 5 and the inside of the tube wall, and is thus stopped.

The delay time of retardation charge 7 is chosen to delay the ignition by means of detonator 9 and primercord 8, and then the combustion of the countermass to an instant as far as possible remote in time from the ejection thereof from tube 1. That is, delay charge 7 clears the communication with working space 2 and lets the flame therefrom reach detonator 9 or fuse 8 as late as the instant the countermass 4 leaves tube 1.

The gases produced by the combustion of countermass 4 then flow past the aircraft and do not endanger the rest aircraft at the rear. These combustion gases mix turbulently with the relatively cool ambient air and may be taken in by the following engines without causing damages.

Figure 3A:
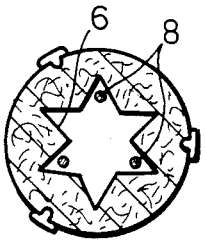
FIGS. 3*a* to 3*c* show different cross sections of the countermass which can be used in accordance with the invention.
Figure 3B:
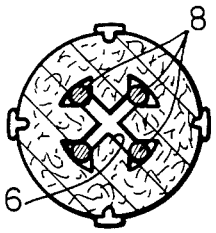
Figure 3C:
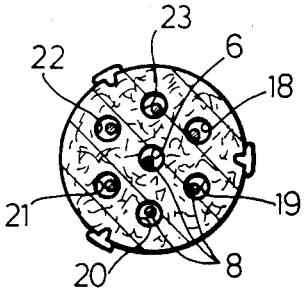

The countermass cross sections show in FIGS. 3*a* to 3*c* differ from that of FIGS. 1 and 2 in that the inner passage 6 is not circular but star shaped (FIG. 3*a*) or cross shaped (FIG. 3*b*) or even formed of a plurality of bores 18 to 23 concentrically arranged about a central bore 6 (FIGS. 3*c*). The fuses or primer cords 8 are distributed correspondingly and in the embodiment of FIG. 3*c*, connecting bores may be provided between the central bore 6 and the surrounding ones 18 to 23.

While specific embodiments of the invention have been shown and described in detail to illustrate the application of the principles of the invention, it will be understood that the invention may be embodied otherwise without departing from such principles.

What is claimed is:

1. A recoiless launching device comprising a launching tube having a bore therethrough with opposite openings, a pair of spaced apart sabots in said bore defining a working space therebetween which can be pressurized with propellant charge vapors for moving said sabots in opposite directions in said tube, one of said sabots being adapted to push a projectile through one end of said tube, a countermass engaged with the other of said sabots to be pushed by the other of said sabots from an opposite end of said tube, said countermass being made of combustible material, and firing connection means connected to said countermass and to said working space for igniting said countermass.

2. A launching device according to claim 1, wherein said firing connection means comprises an explosive delay charge in said countermass.

3. A launching device according to claim 1, wherein said firing connection means includes said other sabot having a firing bore therethrough communicating said working space with said countermass, and a damming layer between said other sabot and said countermass.

4. A launching device according to claim 1, wherein said countermass has an outer circumferential slide layer.

5. A launching device according to claim 4, including a braking sleeve connected in said bore of said tube at said end thereof through which said countermass is to move, said sliding layer being slidably engaged with said braking sleeve, said braking sleeve being shaped to engage said other sabot to prevent said other sabot from leaving said tube.

6. A launching device according to claim 1, including a plurality of spacers connected to and disposed around said countermass and engaged with said tube bore.

7. A launching device according to claim 6, wherein said firing connection means comprises said countermass having a longitudinally extending inner passage communicating with said firing bore, a delay charge in said inner passage communicating with said bore, a detonator in said passage adjacent said delay charge and a primer cord in said inner passage connected to said detonator.

8. A launching device according to claim 1, wherein said countermass comprises of solid propellant and explosive material.

9. A launching device according to claim 8, wherein said countermass is one of extruded or cast explosive or propellant.

10. A launching device according to claim 8, wherein said countermass comprises a nitrocellulose or composite propellant.

11. A launching device according to claim 1, wherein said firing connection means comprises said other sabot having a firing bore therethrough communicating said working space with said countermass.

12. A launching device according to claim 11, wherein said countermass has an inner passage extending therein in a longitudinal direction of said tube bore, communicating with said firing bore of said other sabot.

13. A launching device according to claim 12, wherein said firing connection device includes an explosive delay charge accommodated in said inner passage of said countermass and communicating with said firing bore of said other sabot.

14. A launching device according to claim 13, wherein said firing connection means includes a primer cord in said inner passage of said countermass and a detonator connected to said primer cord.

* * * * *